US006890205B1

(12) United States Patent
Wu

(10) Patent No.: US 6,890,205 B1
(45) Date of Patent: May 10, 2005

(54) CABLE END CONNECTOR ASSEMBLY HAVING LOCKING MEMBER

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/728,533

(22) Filed: Dec. 5, 2003

(51) Int. Cl.[7] ..... H01R 13/627
(52) U.S. Cl. ..... 439/358; 439/906; 439/939; 439/108
(58) Field of Search ..... 439/352–358, 439/108, 906, 939, 607–608

(56) References Cited

U.S. PATENT DOCUMENTS 5,112,243 A * 5/1992 Chow et al. ..... 439/352
6,431,887 B1 * 8/2002 Yeomans et al. ..... 439/108
6,565,383 B1 5/2003 Wu
6,585,536 B1 7/2003 Wu
6,585,537 B1 7/2003 Lee

* cited by examiner

*Primary Examiner*—Truc Nguyen
(74) *Attorney, Agent, or Firm*—Wei Te Chung

(57) ABSTRACT

A cable end connector assembly (10) includes an insulative housing (12), a plurality of contacts (130) received in the insulative housing, a spacer (13) mounted to a rear end of the housing, a cable (14) comprising a plurality of conductors (140) electrically connecting with corresponding contacts, a casing (15) over-molded with the insulative housing and the cable, and a locking member (16). The locking member comprises a retaining section (163) secured with the casing, a main section (160) extending forwardly from the retaining section, and a locking section (161) extending forwardly from the main section. The locking section has a resilient tab (1611) resiliently abutting against the casing and a pair of latch portions (1610) for locking with corresponding portions of the complementary connector.

9 Claims, 9 Drawing Sheets

CABLE END CONNECTOR ASSEMBLY HAVING LOCKING MEMBER

BACKGROUND OF THE INVENTION

1. Field of the Invention

The present invention generally relates to a cable end connector assembly, and particularly to a cable end connector assembly having a locking member for locking with a complementary connector.

2. Description of Related Art

There exists in the art an electrical connector known as a Serial Advanced Technology Attachment (Serial ATA) connector which is generally used for disk drives and storage peripherals. Especially, the Serial ATA connectors according to the Serial ATA standard are featured in fewer electrical contacts than other conventional electrical connectors and are relatively tiny in configuration. It is desirable for the Serial ATA connector to have latch means for providing a reliable mechanical and electrical connection with a complementary connector. U.S. Pat. Nos. 6,565,383 and 6,585,536, having the same inventor and the same assignee with the present invention, each disclose a Serial ATA connector equipped with a locking member for locking with a complementary connector. The locking member comprises a middle portion retained on a connector housing, a pushing portion extending rearwardly from the middle portion, and a locking portion extending forwardly from the middle portion for locking/releasing the Serial ATA connector with/from the complementary connector.

However, since the middle portion of the locking member is retained on the connector housing, the distance between a locking position and a releasing position of the locking portion is relatively small, thereby adversely affecting the engagement and disengagement between the Serial ATA connector and the complementary connector.

Hence, a cable end connector assembly having an improved locking member is highly desired.

BRIEF SUMMARY OF THE INVENTION

Accordingly, it is an object of the present invention to provide a cable end connector assembly having an improved locking member for locking the cable end connector assembly with a complementary connector.

In order to achieve the above-mentioned object, a cable end connector assembly in accordance with the present invention comprises an insulative housing, a plurality of contacts received in the insulative housing, a spacer mounted to a rear end of the housing, a cable comprising a plurality of conductors electrically connecting with corresponding contacts, a casing over-molded with the insulative housing and the cable, and a locking member. The locking member comprises a retaining section secured with the casing, a main section extending forwardly from the retaining section, and a locking section extending forwardly from the main section. The locking section has a resilient tab resiliently abutting against the casing and a pair of latch portions for locking with corresponding portions of the complementary connector.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
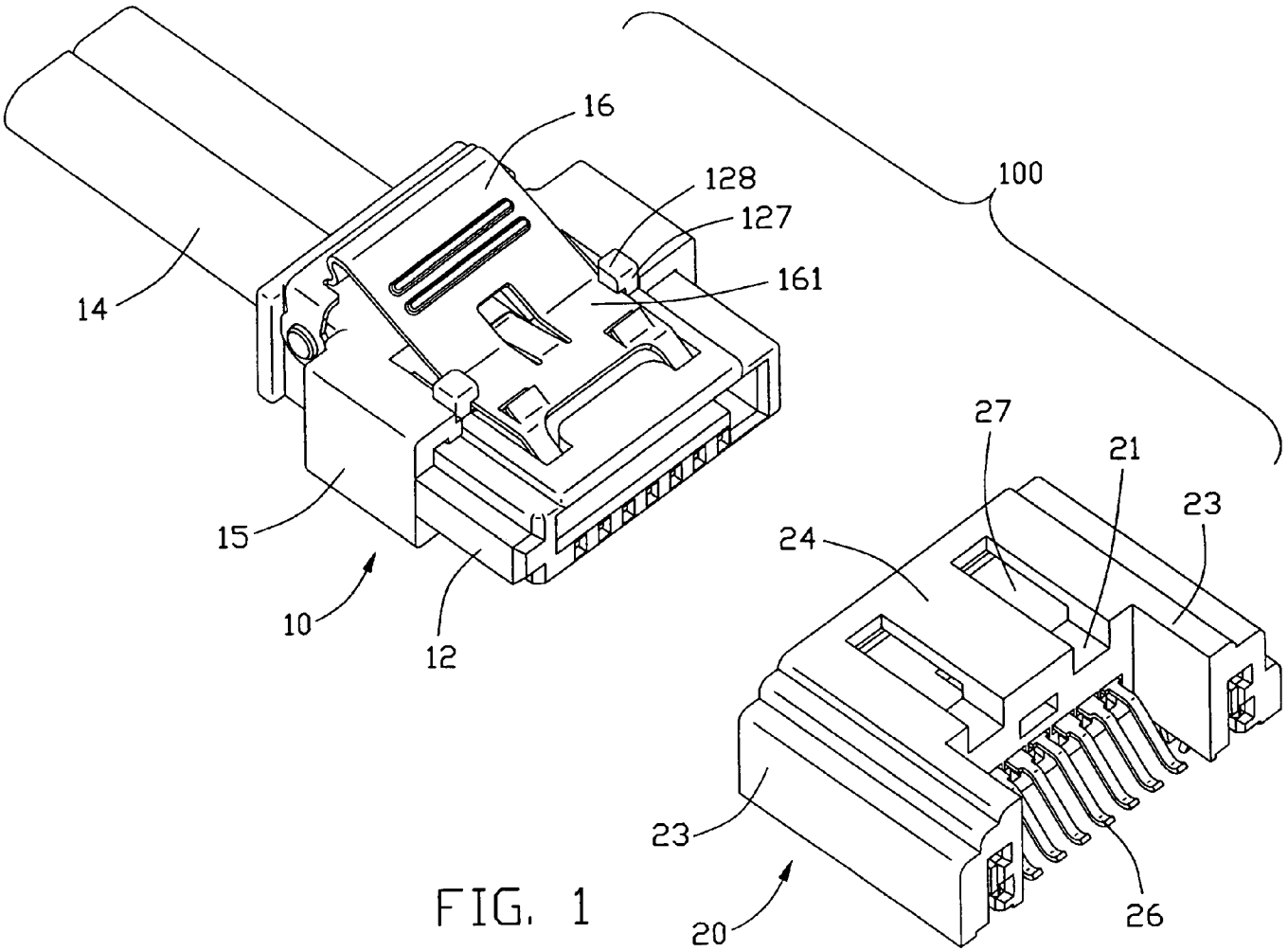
FIG. 1 is a perspective view of an electrical connector assembly, showing a cable end connector assembly in accordance with the present invention and a complementary connector.

Reference will now be made to the drawing figures to describe the present invention in detail.

Figure 2:
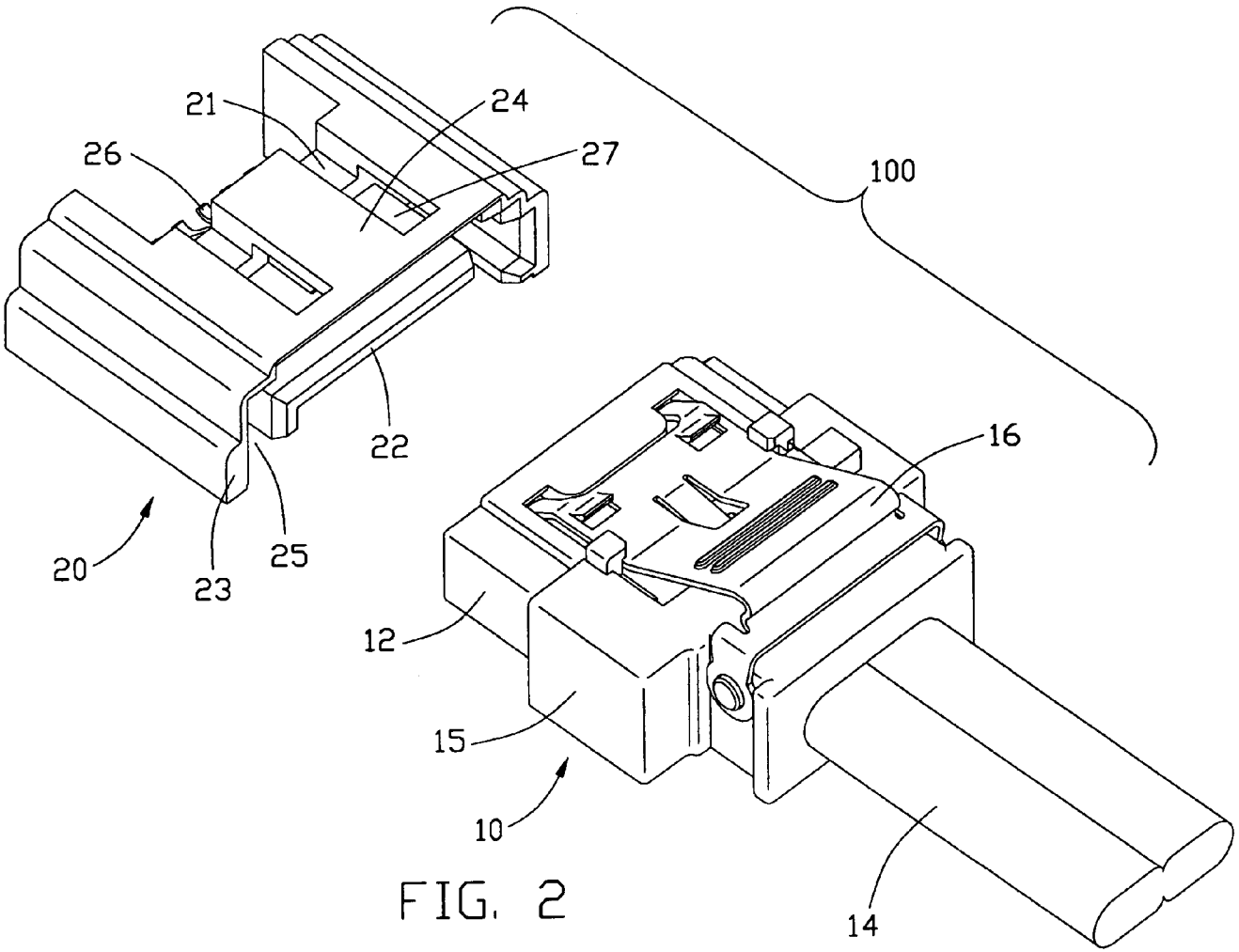
FIG. 2 is a view similar to FIG. 1 while taken from another aspect.

With reference to FIGS. 1–2, an electrical connector assembly 100 comprises a cable end connector assembly 10 in accordance with the present invention and a complementary connector 20. In a preferred embodiment, the cable end connector assembly 10 and the complementary connector 20 are typical Serial ATA connectors. However, in alternative embodiments, the electrical connectors could be provided as other types.

Figure 3:
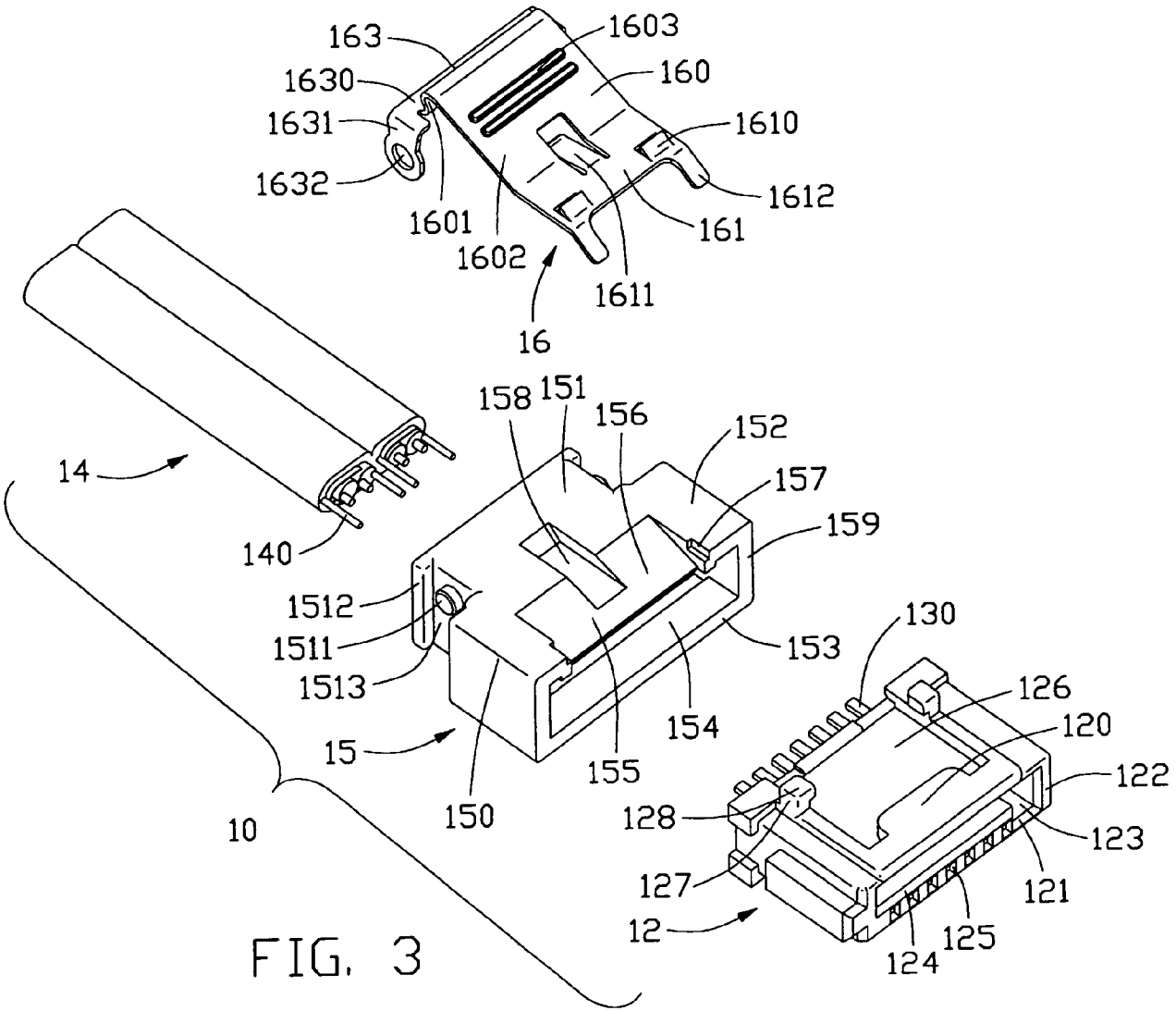
FIG. 3 is an exploded, perspective view of the cable end connector assembly.
Figure 4:
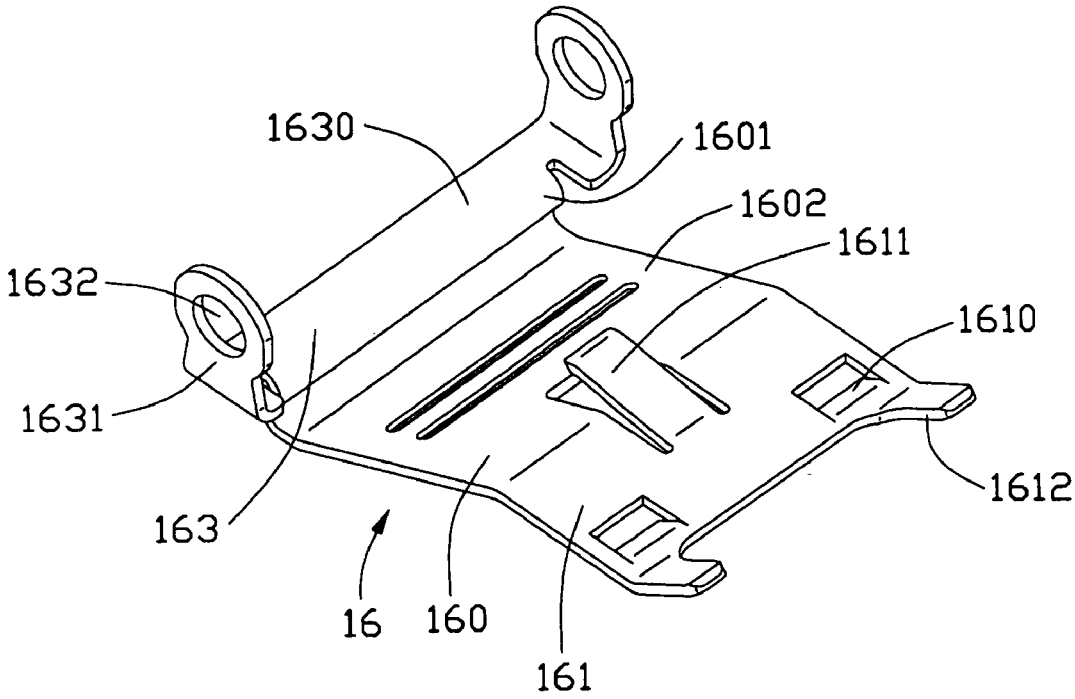
FIG. 4 is a perspective view of a locking member of the cable end connector assembly.
Figure 5:
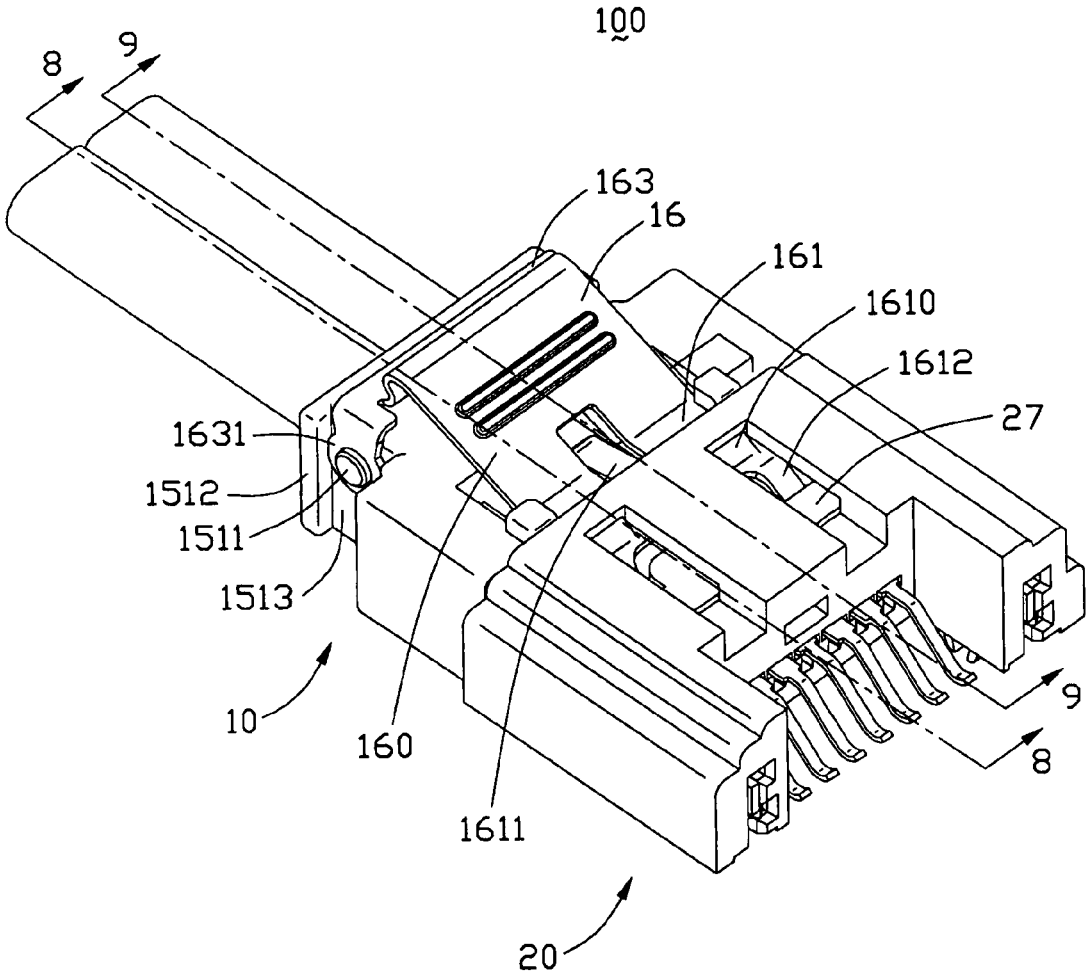
FIG. 5 is an assembled view of the electrical connector assembly shown in FIG. 1.
Figure 6:
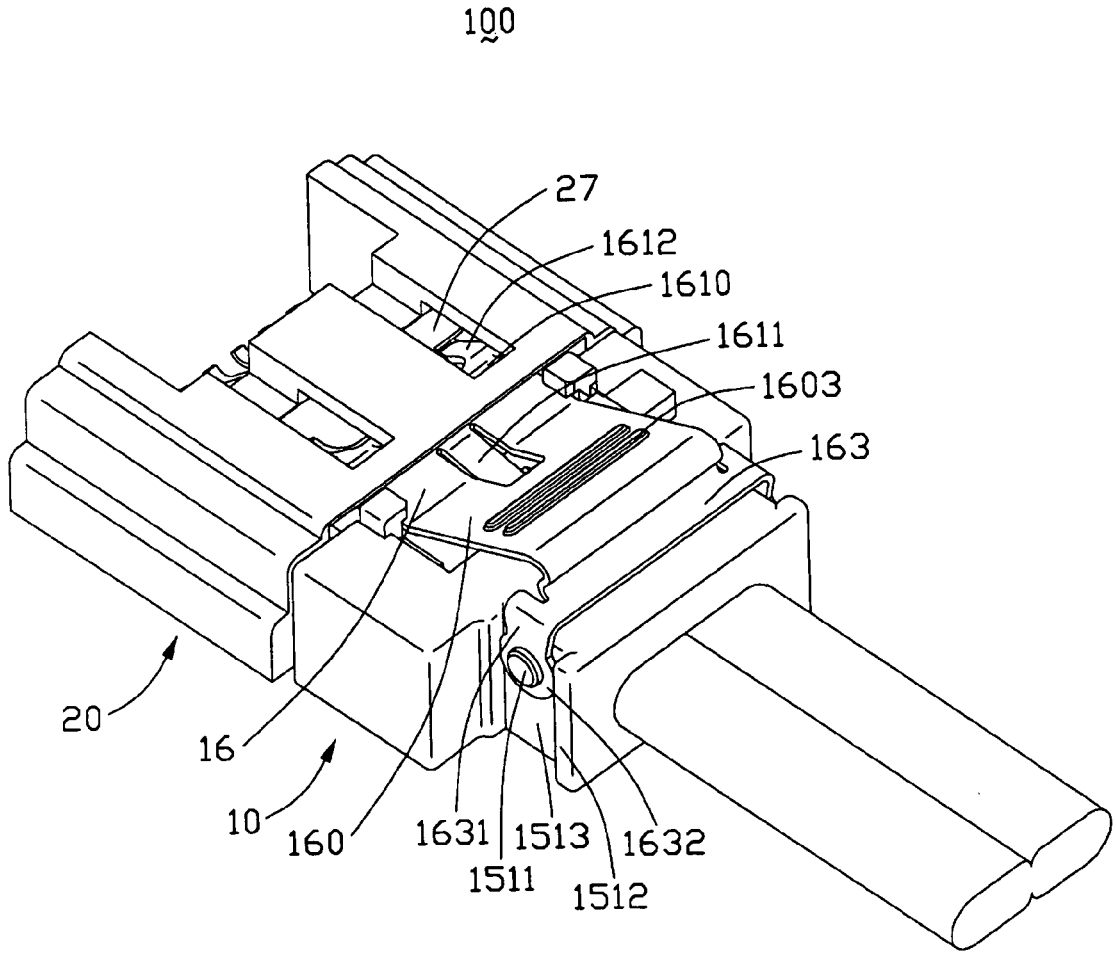
FIG. 6 is an assembled view of FIG. 2.
Figure 7:
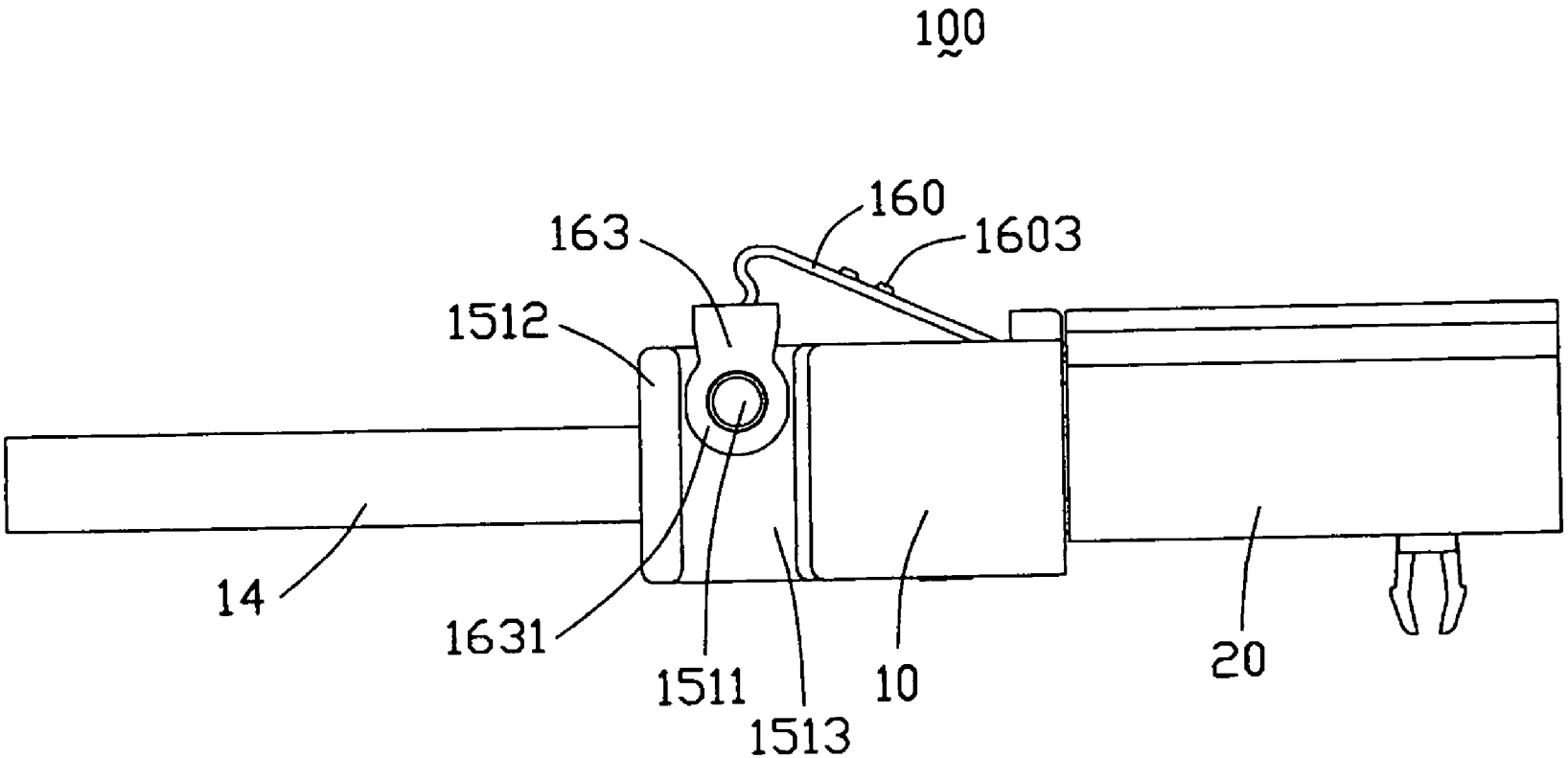
FIG. 7 is a side view of the electrical connector assembly.

Referring to FIGS. 3 and 4 in conjunction with FIGS. 5–7, the cable end connector assembly 10 comprises an insulative housing 12, a plurality of contacts 130, a spacer 13 (FIG. 5), a cable 14, an insulative casing 15 and a locking member 16. The insulative housing 12 comprises an upper wall 120, a lower wall 121 opposite to the upper wall 120, and a pair of sidewalls 122 connecting with the upper and the lower walls 120, 121. An L-shaped receiving space 123 is defined in the housing 12, and a block 124 is formed on the lower wall 121 and protrudes into the L-shaped receiving space 123. The block 124 defines a plurality of passageways 125 extending therethrough. A depression 126 is recessed from an upper face of the upper wall 120. A pair of protrusions 127 protrude upwardly from the upper face of the upper wall 120 and at opposite sides of the depression 126, each with a projection 128 extending oppositely above the depression 126.

The contacts 130 are received in the passageways 125 of the insulative housing 12 with tail portions (not labeled) thereof extending rearwardly beyond a rear face of the insulative housing 12. The spacer 13 is mounted to a rear end of the insulative housing 12 and defines a plurality of through-holes (not labeled) for allowing the tail portions of the contacts 130 extending therethrough. The spacer 13 can prevent plastic from entering into the passageways 125 of the insulative housing 12 during the molding of the casing 15. The contacts 130 and the spacer 13 can be integrally formed before mounting to the insulative housing 12, if desired.

The cable 14 comprises a plurality of conductors 140 exposed outside for connecting with the contacts 130.

The casing 15 is over-molded with the insulative housing 12 and the cable 14, and comprises a rectangular body portion 150 and a reduced rear portion 151 extending rearwardly from the body portion 150. The body portion 150 comprises an upper plate 152, a lower plate 153 opposite to the upper plate 152, and a pair of side plates 159 connecting with the upper and the lower plates 152, 153. A receiving cavity 154 is defined between the upper and the lower plates 152, 153 for receiving a rear end of the insulative housing 12. A recess 155 is defined in the front end of the upper plate 152 which forms an inclined surface 156 on a bottom thereof. A pair of cutouts 157 are defined in opposite inner sides of the recess 155 and adjacent to the front end of the upper plate 152. The upper plate 152 defines a central slot 158 communicating with the recess 155. The rear portion 151 defines a hole 1510 (FIG. 8) communicating with the receiving cavity 154 for receiving the cable 14. Each side of the rear portion 151 forms thereon a retaining post 1511 and a bar 1512 located behind the retaining portion 1511 which protrudes laterally. A slot 1513 is such defined between a corresponding bar 1512 and the body portion 150.

Particularly referring to FIG. 3 together with FIG. 4, the locking member 16 is stamped and formed from a metallic plate and comprises a retaining section 163, a main section 160, and a locking section 161. The retaining section 163 comprises a main body 1630 and a pair of retaining arms 1631 extending downwardly from opposite sides of the main body 1630. Each retaining arm 1631 defines an aperture 1632 in correspondence to the retaining post 1511 of the cover 15. The main section 160 comprises a connecting portion 1601 extending upwardly from the main body 1630 of the retaining section 163 and an inclined portion 1602 extending forwardly and downwardly from the connecting portion 1601. The inclined portion 1602 is formed with a plurality of ribs 1603 protruding outwardly for facilitating handling. The locking section 161 extends forwardly from the inclined portion 1602 and comprises a pair of latch tabs 1610 extending obliquely and outwardly toward the main section 160, a resilient tab 1611 extending obliquely and inwardly toward the main section 160, and a pair of guiding portions 1612 extending forwardly and downwardly at a front end thereof.

Referring to FIGS. 1–3 and 5–7, in assembly, the conductors 140 of the cable 14 are first soldered to the contacts 130, which are exposed outside the insulative housing 12. The casing 15 is over-molded with the rear end of the housing 12 with the front end of the cable 14 being received in the hole 1510. The locking member 16 is then assembled to the insulative housing 12 and the casing 15. The retaining section 163 partially encloses the rear portion 151 of the casing 15 with the retaining arms 1631 extending in the slots 1513 of the rear portion 151 and being securely received in the apertures 1632. The front end of the inclined portion 1602 and the locking section 161 are deflectably received in the recess 155 and the depression 126. The projections 128 of the protrusions 127 press against opposite side edges of the locking section 161 to prevent the locking section 161 from moving away under the resilient force exerted by the resilient tab 1611 which abuts against bottom surface of the central slot 158.

Referring to FIGS. 1 and 2 in conjunction with FIGS. 5 and 6, the complementary connector 20 comprises a base portion 21, an L-shaped tongue portion 22 extending forwardly from a middle portion of the base portion 21 along a mating direction, a pair of side portions 23 extending from opposite sides of the base portion 21, and a traverse portion 24 extending above the L-shaped tongue portion 22 and connecting the two side portions 23. A mating space 25 is defined in the complementary connector 20. A plurality of terminals 26 are received in the L-shaped tongue portion 22 and each terminal 26 has a tail portion (not labeled) extending beyond a rear face of the base portion 21 for connecting to a printed circuit board (not shown) on which the complementary connector 20 is mounted. The traverse portion 24 defines a pair of engaging openings 27 extending along the mating direction and communicating with the mating space 25.

Figure 8:
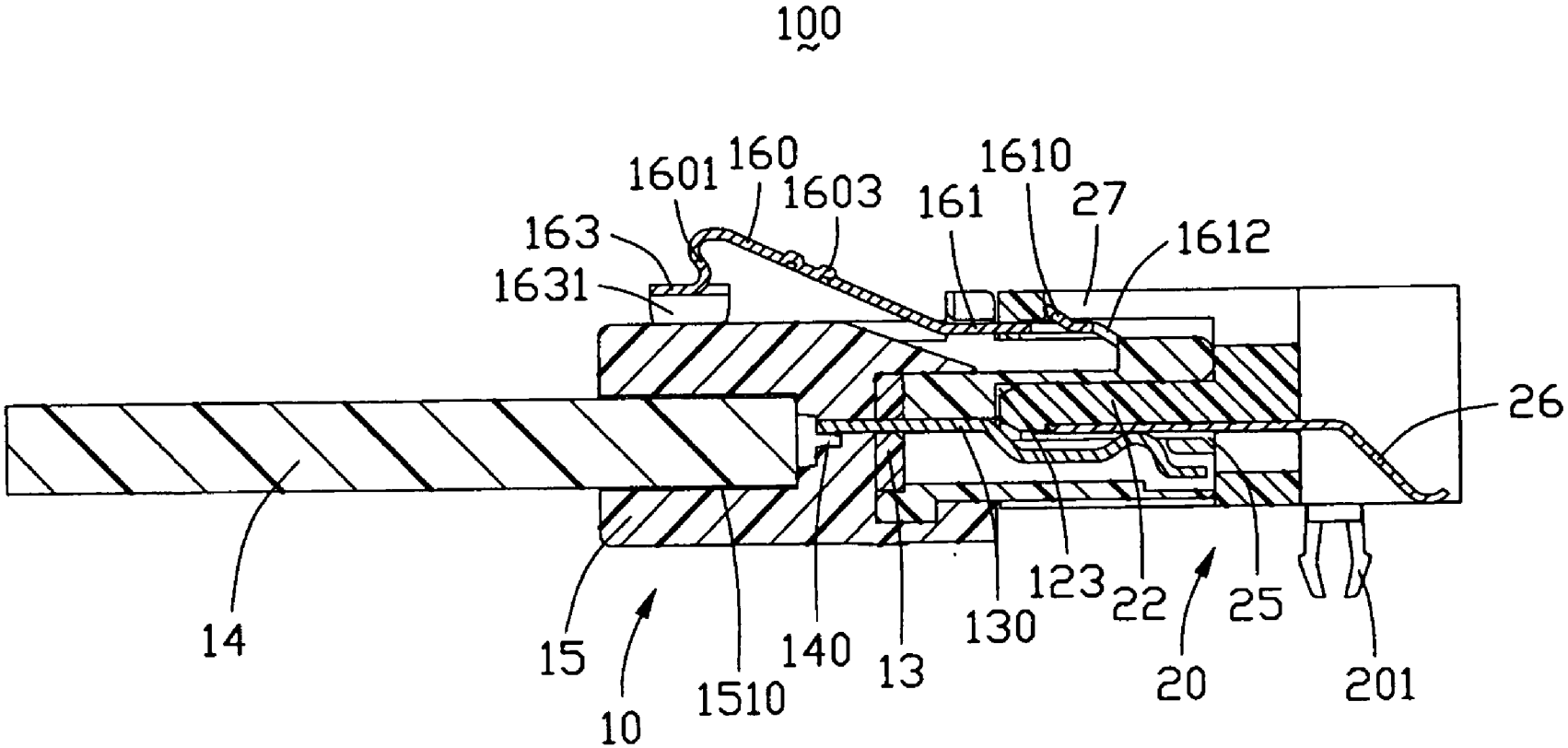
FIG. 8 is a cross-sectional view of FIG. 5 taken along line 8—8.
Figure 9:
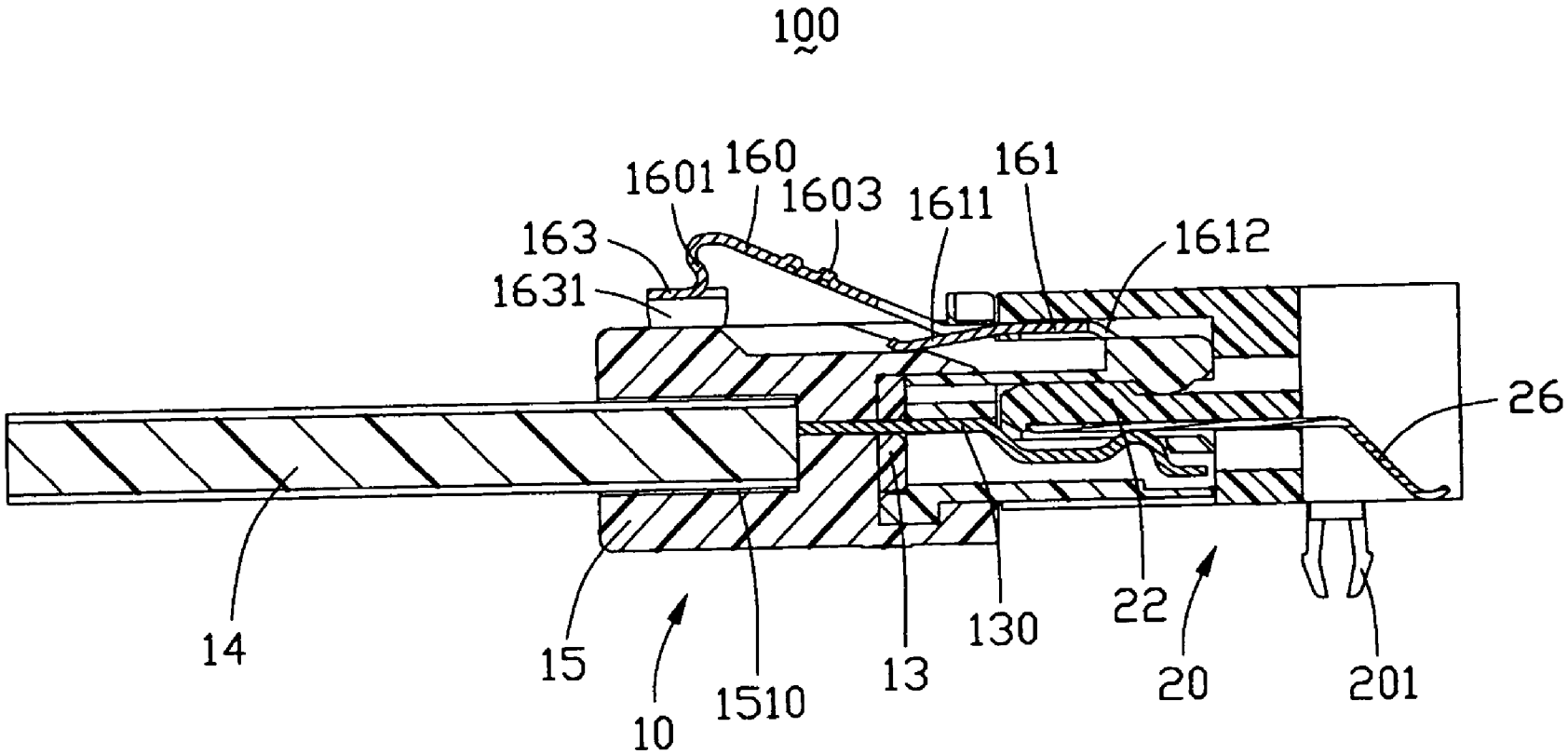
FIG. 9 is a cross-sectional view of FIG. 5 taken along line 9—9.

Turning to FIGS. 8 and 9, when the cable end connector assembly 10 engages with the complementary connector 20, a front end of the cable end connector assembly 10 is inserted into the mating space 25 of the complementary connector 20 and the L-shaped tongue portion 22 of the complementary connector 20 is received in the receiving space 123 of the cable end connector assembly 10. The guiding portions 1612 guide the insertion of the locking section 161 into the mating space 25 of the complementary connector 20. The latch tabs 1610 are exposed in the engaging openings 27 and abut against forward edges of the engaging openings 27 under the force exerted by the elasticity of the resilient tab 1611. When the cable end connector assembly 10 is to be disengaged from the complementary connector 20, the operator is required to press downwardly the main section 160 of the locking member 16 under a condition of the retaining section 163 being pivoted about the retaining post 1511, thereby releasing the locking section 161 from engagement with the complementary connector 20.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. A cable end connector assembly for mating with complementary connector, comprising:

an insulative housing;

a plurality of contacts received in the insulative housing;

a cable comprising a plurality of conductors electrically connecting with corresponding contacts;

a casing overmolded on a rear end of the housing and having a pair of retaining posts defined at opposite sides thereof; and a locking member comprising a retaining section partially enclosing a rear portion of the casing, a main section extending forwardly from the retaining section, and a locking section extending forwardly from the main section and having a latch portion for locking with the complementary connector, the retaining section having a pair of retaining arms, each defining an aperture securely receiving the corresponding retaining post;

wherein the casing defines a central slot, and wherein the locking section has a resilient tab resiliently abutting against a bottom of the central slot;

wherein the locking section comprises a pair of latch tabs extending obliquely toward the main section, and a pair of guiding portions extending forwardly.

2. The cable end connector assembly as described in claim 1, wherein the locking section is movable with the main section and deflectable with respect to the casing and the insulative housing.

3. The cable end connector assembly as described in claim 2, wherein the insulative housing defines a depression and the cover defines a recess communicating with the depression, and wherein the locking section and a front end of the main section are respectively deflected into the depression and the recess when the locking section is mating with the complementary connector.

4. The cable end connector assembly as described in claim 1, wherein the retaining section comprises a main body with the two retaining arms extending downwardly therefrom.

5. The cable end connector assembly as described in claim 4, wherein the main section comprises a connecting portion extending upwardly from the main body of the retaining section and an inclined portion extending forwardly and downwardly from a top end of the connecting portion.

6. The cable end connector assembly as described in claim 1, wherein the casing comprises a rectangular body portion with the rear portion extending rearwardly therefrom and a receiving cavity defined in the rectangular body portion.

7. An electrical connector assembly comprising:

an insulative housing;

a plurality of contacts disposed in the housing;

a casing fixed on a rear end of the housing and having a pair of retaining posts defined at opposite sides thereof;

a locking member pivotally fastened to at least one of said housing and said casing, said locking member including a retaining section pivotally mounted to said one of said housing and said casing, a latching section for latching to a complementary connector and a main section located between said retaining section and said latching section for pressing;

wherein the retaining section includes a main body with a pair of vertical retaining arms each defining an aperture securely receiving the corresponding retaining post;

wherein when the main section is downwardly pressed, the latching section is also downwardly moved for releasing.

8. The connector assembly as described in claim 7, wherein a cable including a plurality of conductors, is connected to the contacts and enclosed in the casing.

9. The connector assembly as described in claim 8, wherein said locking member is pivotally fastened to the casing.

* * * * *